US011589716B2

(12) United States Patent
Birdsong

(10) Patent No.: US 11,589,716 B2
(45) Date of Patent: Feb. 28, 2023

(54) ADJUSTABLE BATHING CHAIR ASSEMBLY

(71) Applicant: Joyce Birdsong, Lakewood, CA (US)

(72) Inventor: Joyce Birdsong, Lakewood, CA (US)

( * ) Notice: Subject to any disclaimer, the term of this patent is extended or adjusted under 35 U.S.C. 154(b) by 109 days.

(21) Appl. No.: 17/361,525

(22) Filed: Jun. 29, 2021

(65) Prior Publication Data

US 2022/0408980 A1 Dec. 29, 2022

(51) Int. Cl.
*A47K 3/12* (2006.01)

(52) U.S. Cl.
CPC ..... *A47K 3/122* (2013.01)

(58) Field of Classification Search
CPC ..... A47K 3/122; A47K 3/282
See application file for complete search history.

(56) References Cited

U.S. PATENT DOCUMENTS

| | | | | |
|---|---|---|---|---|
| 4,527,829 | A * | 7/1985 | Fanslau | A61G 5/085 297/29 |
| 5,103,509 | A | 4/1992 | Richards | |
| 5,377,366 | A | 1/1995 | Boyd | |
| D392,808 | S | 3/1998 | Newick | |
| 6,158,809 | A | 12/2000 | Gobbers | |
| 6,553,582 | B1 * | 4/2003 | Clark | E03D 11/135 4/252.2 |
| 6,553,585 | B1 * | 4/2003 | Lundstrom | A61G 7/1007 4/667 |
| 6,754,917 | B1 * | 6/2004 | Rhoades | A61G 7/1017 4/667 |
| 7,506,385 | B2 | 3/2009 | Werschmidt | |
| 8,276,220 | B1 | 10/2012 | Seymour | |
| 10,369,066 | B2 | 8/2019 | Spence | |
| 2007/0083990 | A1 * | 4/2007 | Werschmidt | A61G 7/1019 4/560.1 |
| 2020/0148366 | A1 * | 5/2020 | Fagan | B64D 11/0648 |

FOREIGN PATENT DOCUMENTS

| | | | |
|---|---|---|---|
| JP | 2005224558 | * | 5/2007 |
| KR | 200275771 | * | 5/2002 |
| WO | WO2007046814 | | 4/2007 |

* cited by examiner

*Primary Examiner* — J C Jacyna

(57) ABSTRACT

An adjustable bathing chair assembly includes a seat that has a slot is integrated into the seat such that that a user's genitals and inner thighs are accessible through the seat. A plurality of hydraulic pistons is each coupled to and extends downwardly from the seat such that each of the hydraulic pistons to support the seat above a floor of the bathtub. Each of the hydraulic pistons has an adjustable length. A pair of hydraulic pumps is each integrated into the seat and each of the hydraulic pumps is in fluid communication with a respective pair of the hydraulic pistons. Each of the hydraulic pumps is actuatable in a lowering condition to raise the seat and each of the hydraulic pumps is actuatable in a lifting condition to lower to the seat.

7 Claims, 6 Drawing Sheets

ADJUSTABLE BATHING CHAIR ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to bathing chair devices and more particularly pertains to a new bathing chair device for facilitating a physically disabled user to bathe themselves. The device includes a seat with a slot to facilitate the user to bathe their genitals while the user is seated. The device includes a plurality of hydraulic pistons that serve as legs for the seat and the hydraulic pistons lift and lower the seat depending on the user's preference.

(2) Description of Related Art Including Information Disclosed Under 37 CFR 1.97 and 1.98

The prior art relates to bathing chair devices including a lifting chair that includes a hydraulic piston integrated into a back rest of the lifting chair for lifting or lowering the chair. Additionally, the prior art discloses a bathing chair that includes a lifting frame and a hydraulic piston being integrated into the lifting frame for lifting or lowering the bathing chair. The prior art discloses a chair that includes legs which have a telescopically adjustable height for raising or lowering the chair.

BRIEF SUMMARY OF THE INVENTION

An embodiment of the disclosure meets the needs presented above by generally comprising a seat that has a slot is integrated into the seat such that that a user's genitals and inner thighs are accessible through the seat. A plurality of hydraulic pistons is each coupled to and extends downwardly from the seat such that each of the hydraulic pistons to support the seat above a floor of the bathtub. Each of the hydraulic pistons has an adjustable length. A pair of hydraulic pumps is each integrated into the seat and each of the hydraulic pumps is in fluid communication with a respective pair of the hydraulic pistons. Each of the hydraulic pumps is actuatable in a lowering condition to raise the seat and each of the hydraulic pumps is actuatable in a lifting condition to lower to the seat.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
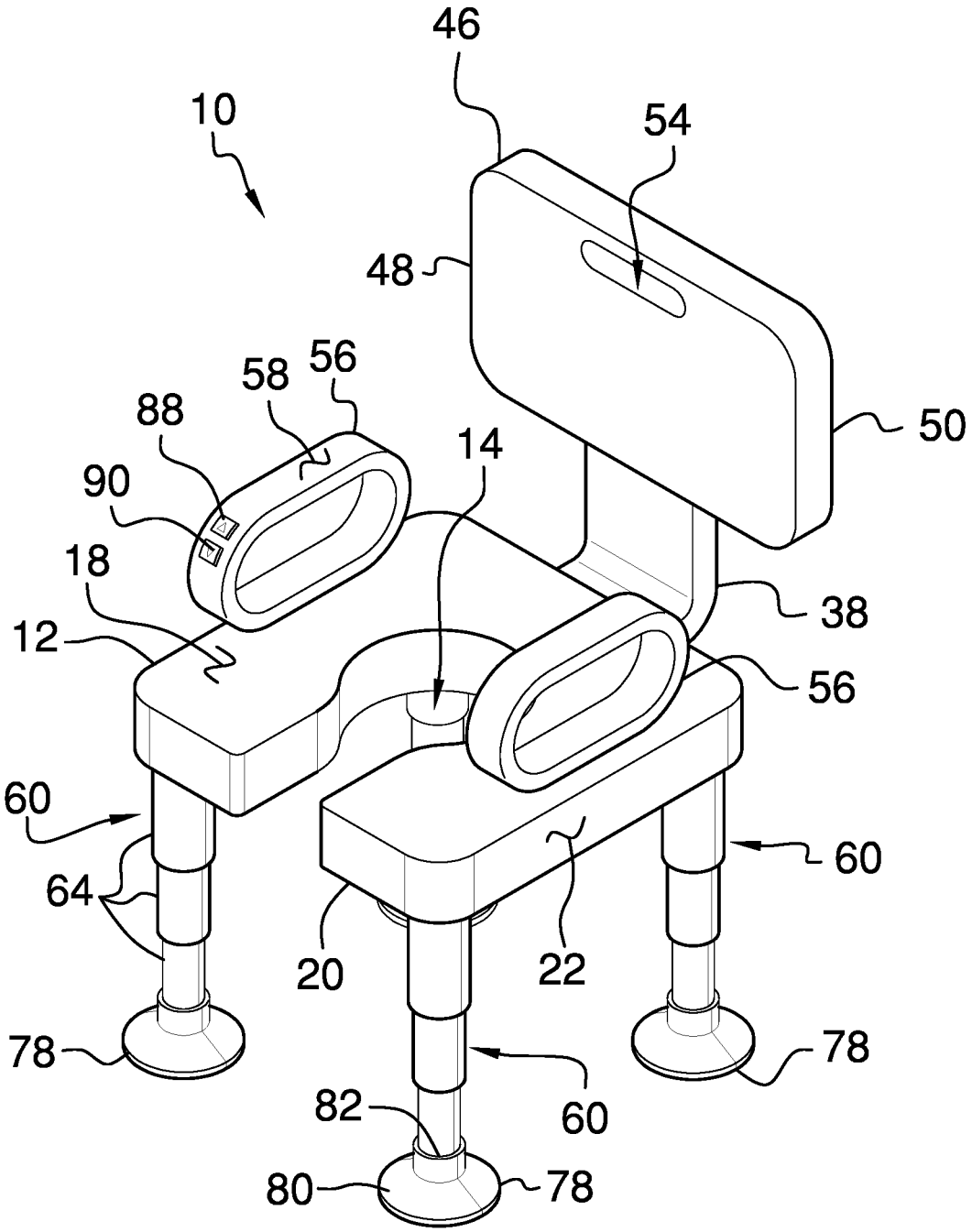
FIG. 1 is a top perspective view of an adjustable bathing chair assembly according to an embodiment of the disclosure.
Figure 2:
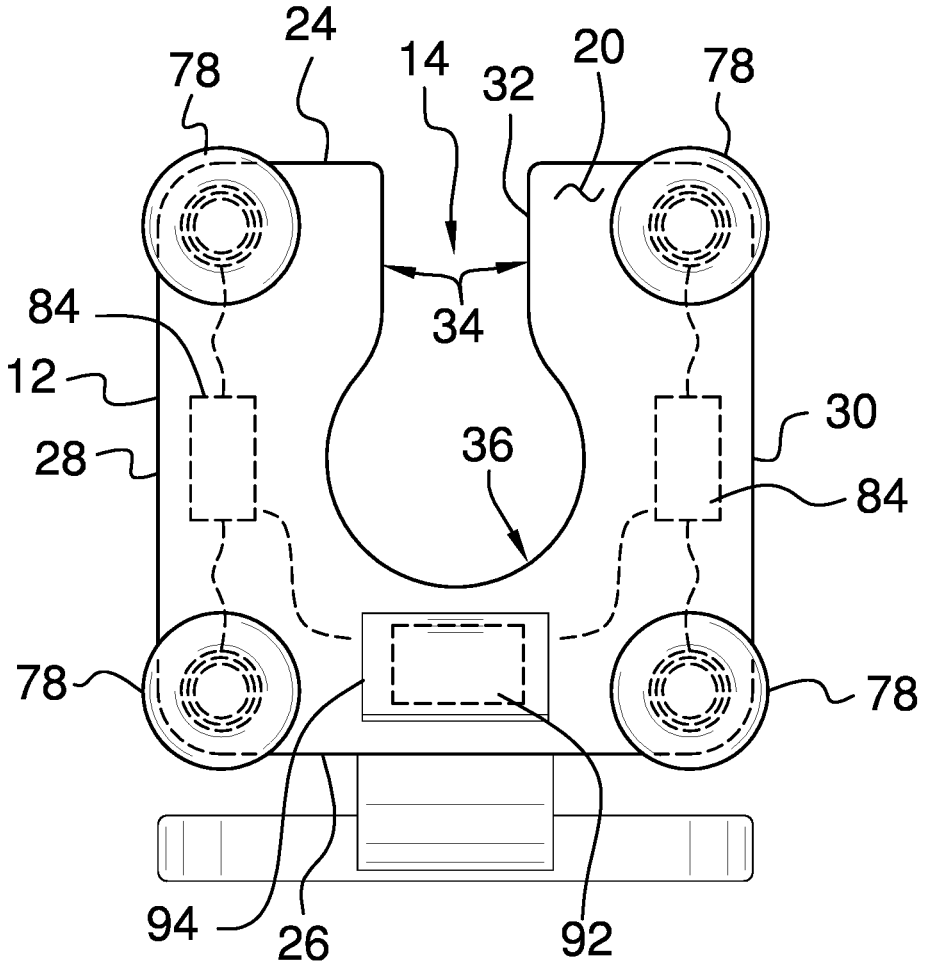
FIG. 2 is a bottom phantom view of an embodiment of the disclosure.
Figure 3:
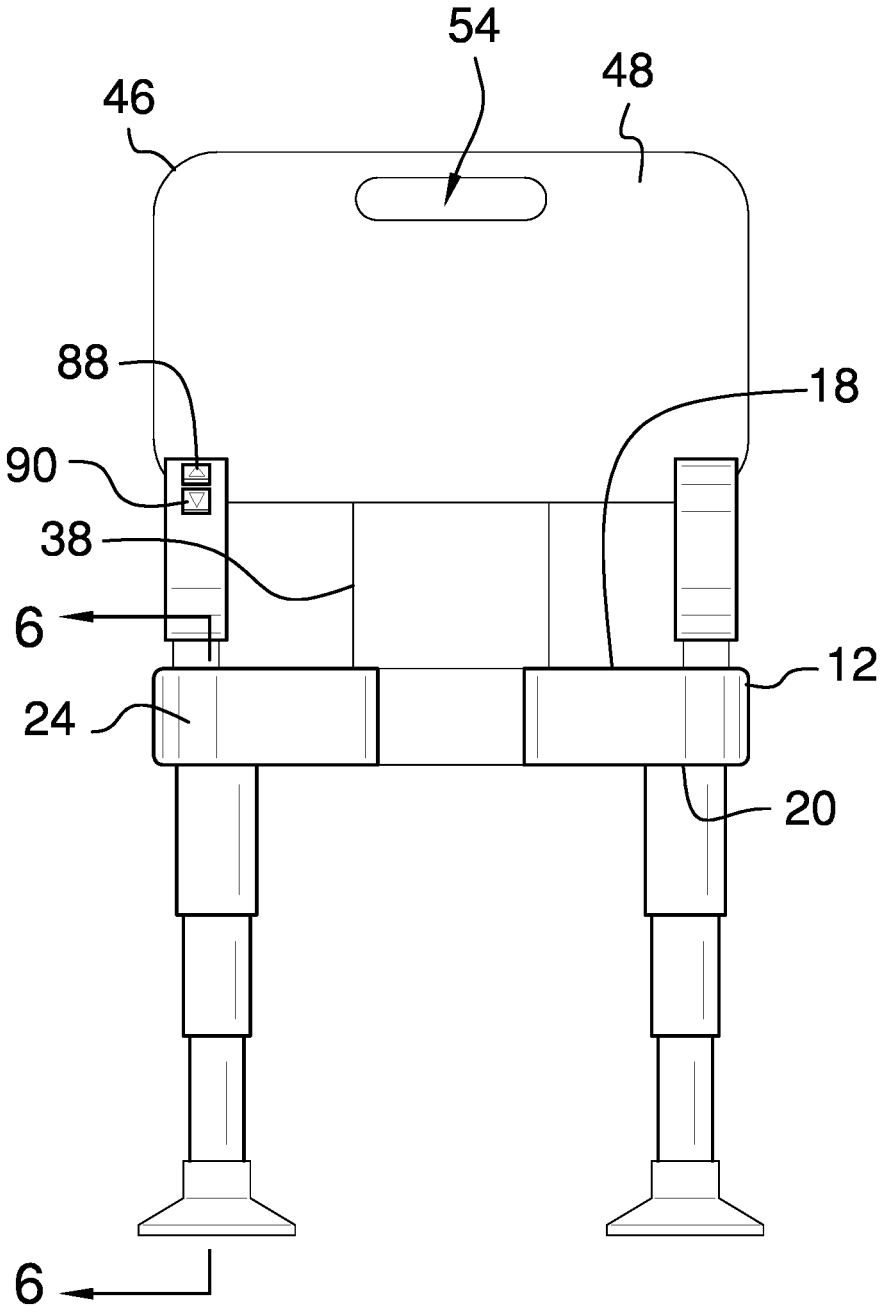
FIG. 3 is a front view of an embodiment of the disclosure.
Figure 4:
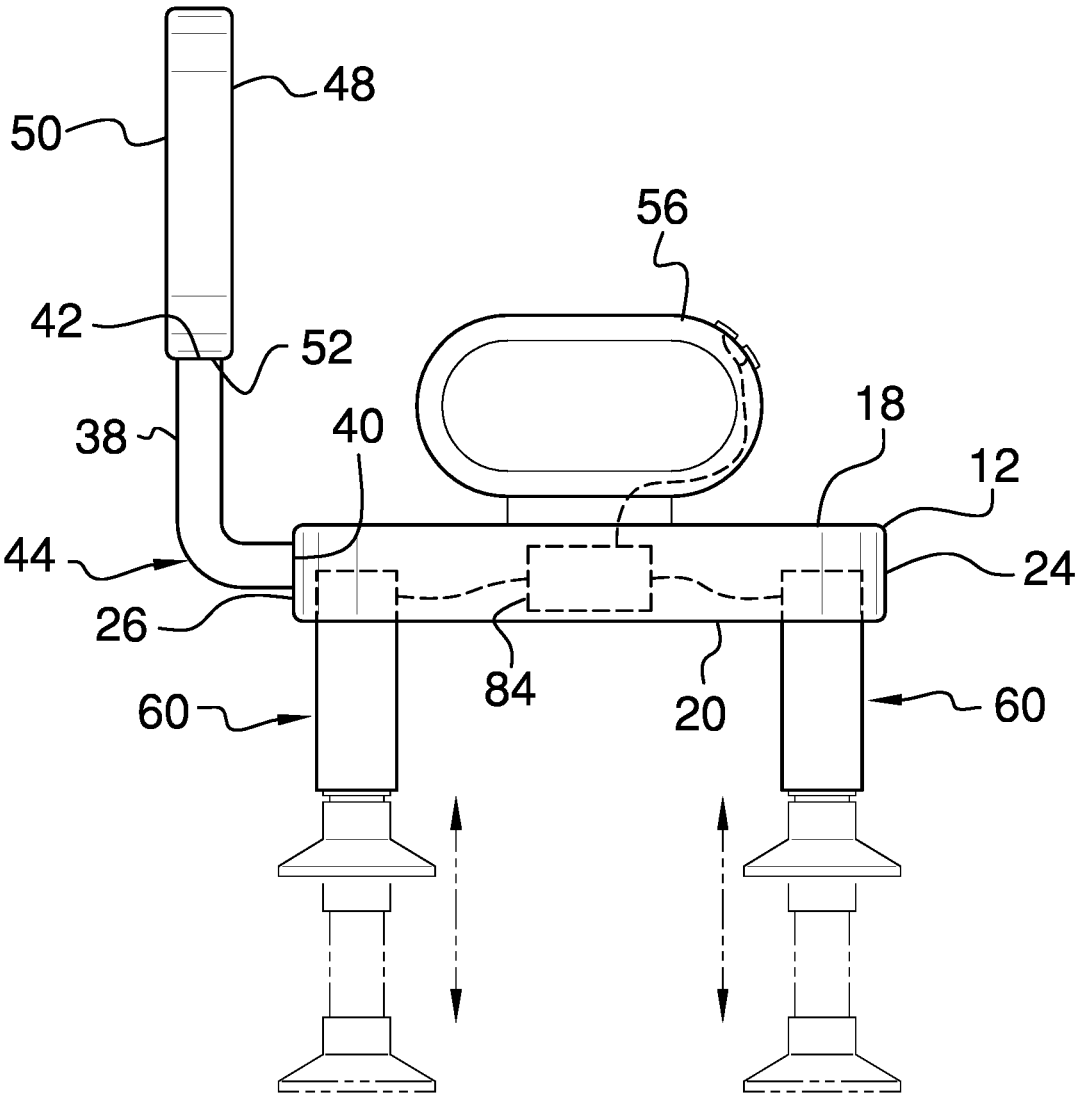
FIG. 4 is a right side phantom view of an embodiment of the disclosure.
Figure 5:
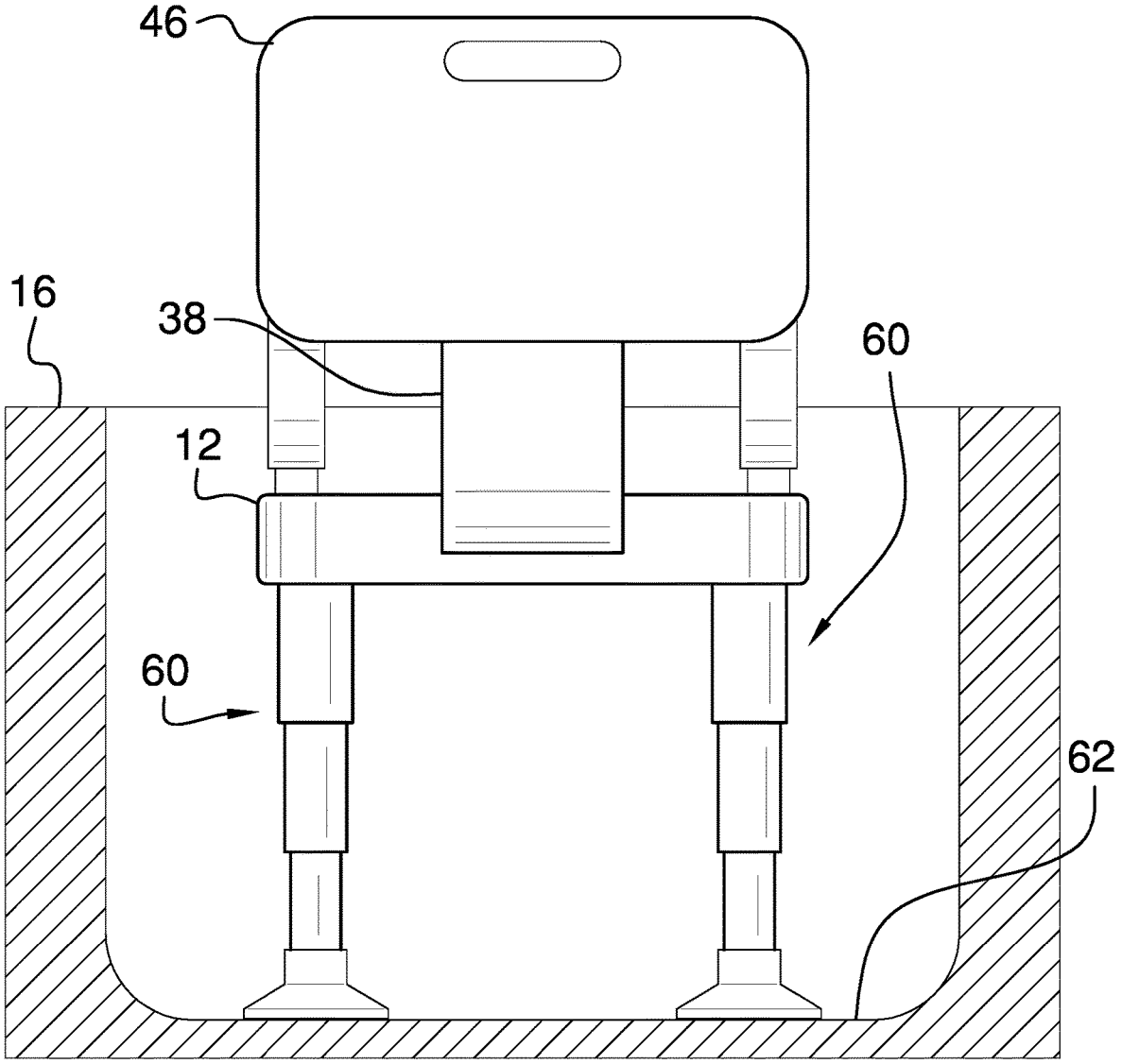
FIG. 5 is a back view of an embodiment of the disclosure.
Figure 6:
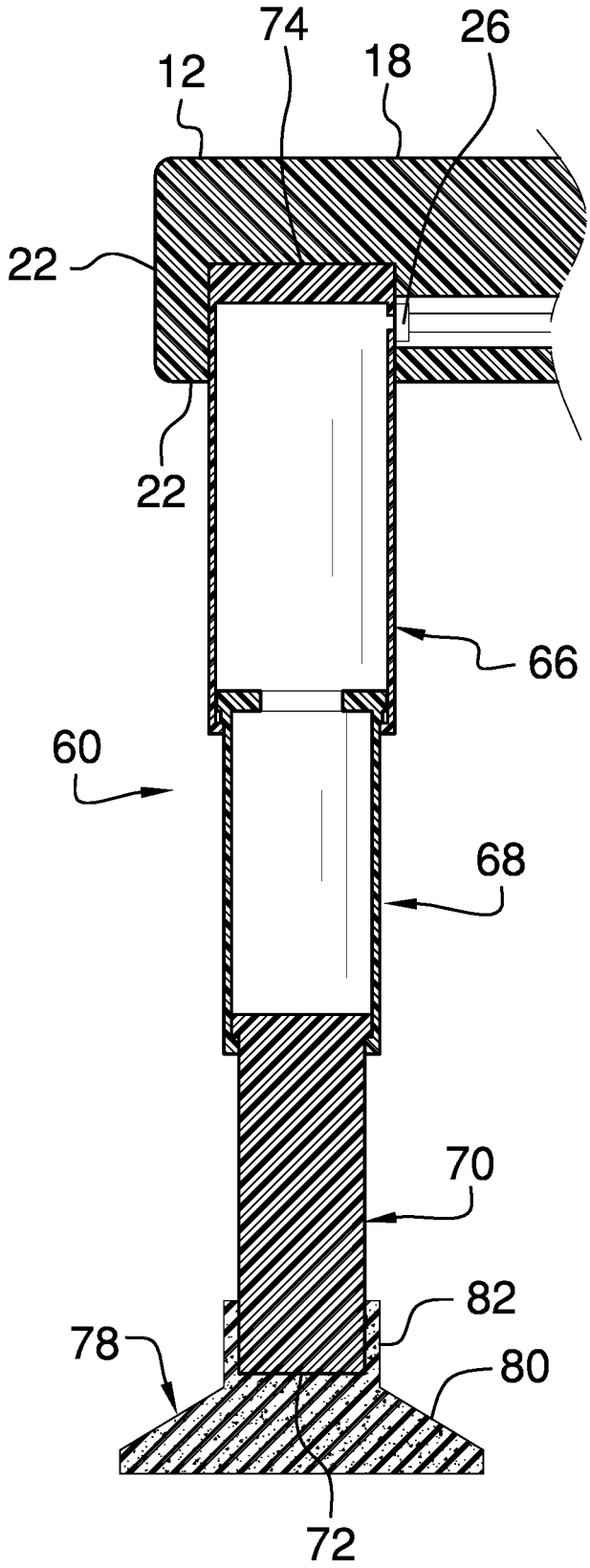
FIG. 6 is a cross sectional view taken along of an embodiment of the disclosure.

With reference now to the drawings, and in particular to FIGS. 1 through 6 thereof, a new bathing chair device embodying the principles and concepts of an embodiment of the disclosure and generally designated by the reference numeral 10 will be described.

As best illustrated in FIGS. 1 through 6, the adjustable bathing chair assembly 10 generally comprises a seat 12 that has a slot 14 integrated into the seat 12. In this way a user can sit on the seat 12 such that the user's genitals and inner thighs are accessible through the seat 12. The seat 12 is comprised of a fluid impermeable material such that the seat 12 can be positioned in a bathtub 16 to facilitate the user to bathe themselves. In this way the slot 14 facilitates the user to wash their genitals and inner thighs while the user is seated. The user may be a physically disabled user that is not capable of bathing themselves without assistance.

The seat 12 has a top surface 18, a bottom surface 20 and a perimeter surface 22 extending between the top surface 18 and the bottom surface 20, and the perimeter surface 22 has a front side 24, a back side 26, a first lateral side 28 and a second lateral side 30. The slot 14 extends through the top surface 18 and the bottom surface 20, and the slot 14 extends from the front side 24 toward the back side 26. The slot 14 has a bounding edge 32 and the bounding edge 32 has a pair of parallel sections 34 and a rounded section 36. Each of the parallel sections 34 extend from the front side 24 toward the back side 26 and the parallel sections 34 are oriented parallel to each other. Additionally, the rounded section 36 extends between the parallel sections 34 having the rounded section 36 being centrally positioned on the seat 12.

A back rest support 38 is provided which has a first end 40 and a second end 42, and the back rest support 38 has a bend 44 thereon. The first end 40 is coupled to the back side 26 of the perimeter surface 22 of the seat 12 having the second end 42 being directed upwardly from the seat 12. A back rest 46 is disposed on the seat 12 such that the back rest 46 can support the user's back. The back rest 46 has a front side 48, a back side 50 and a bottom edge 52, and the bottom edge 52 is coupled to the second end 42 of the back rest support 38. Additionally, the back rest 46 has a hole 54 extending through the front side 24 and the back side 26 to facilitate the back rest 46 to be gripped.

A pair of closed loops 56 is each coupled to and extends upwardly from the seat 12 such that each of the closed loops 56 defines an arm rest. Each of the closed loops 56 has an outer surface 58 and the outer surface 58 of each of the closed loops 56 is coupled to the top surface 18 of the seat 12. Each of the closed loops 56 is positioned adjacent to a respective one of the first lateral side 28 and the second lateral side 30 of the perimeter surface 22 of the seat 12. Additionally, each of the closed loops 56 is elongated to extend substantially between the front side 24 and the back side 26 of the perimeter surface 22.

A plurality of hydraulic pistons 60 is each coupled to and extends downwardly from the seat 12 such that each of the hydraulic pistons 60 defines a respective leg of the seat 12. In this way each of the hydraulic pistons 60 can support the seat 12 above a floor 62 of the bathtub 16. Each of the hydraulic pistons 60 comprises a plurality of telescopic sections 64 that slidably engage each other such that each of the hydraulic pistons 60 has an adjustable length. The plurality of telescopic sections 64 of each of the hydraulic pistons 60 includes a top section 66, a middle section 68 and a bottom section 70. Each of the top section 66 and the middle section 68 is hollow and the top section 66 and the middle section 68 are in fluid communication with each other.

The bottom section 70 has a distal end 72 with respect to the middle section 68 and the top section 66 has a top end 74. The top end 74 of the top section 66 of each of the hydraulic pistons 60 is recessed into the bottom surface 20 of the seat 12. Additionally, each of the hydraulic pistons 60 is aligned with a respective one of four corners of the seat 12. The top section 66 of each of the hydraulic pistons 60 has an input port 76 extending into an interior of the top section 66.

A plurality of feet 78 is each coupled to a respective one of the hydraulic pistons 60 and each of the feet 78 rests on the floor 62 of the bathtub 16. Each of the feet 78 includes a cup 80 and a collar 82 extending upwardly from the cup 80. The collar 82 insertably receives the distal end 72 of the bottom section 70 of the respective hydraulic piston 60. The cup 80 is comprised of a deformable material such that the cup 80 can be compressed against the floor 62 of the bathtub 16 for suctionally engaging the floor 62.

A pair of hydraulic pumps 84 is provided and each of the hydraulic pumps 84 is integrated into the seat 12. Each of the hydraulic pumps 84 is in fluid communication with a respective pair of the hydraulic pistons 60. Each of the hydraulic pumps 84 is actuatable in a lowering condition to extend the hydraulic pistons 60. In this way the seat 12 can be raised from the floor of the bathtub 16. Each of the hydraulic pumps 84 is actuatable in a lifting condition to retract the hydraulic pistons 60 such that the seat 12 can be lowered to the floor of the bathtub 16. Each of the hydraulic pumps may comprise an electric hydraulic pump or the like that includes a hydraulic fluid reservoir. A plurality of conduits 86 is each fluidly coupled between a respective one of the hydraulic pumps 84 and the input port 76 on the top section 66 of a respective one of the hydraulic pistons 60 to direct hydraulic fluid into and out of the respective hydraulic piston 60.

An up button 88 is movably integrated into a respective one of the closed loops 56 such that the up button 88 is accessible to the user. The up button 88 is electrically coupled to the pair of hydraulic pumps 84 and each of the hydraulic pumps 84 is actuated into the lowering condition when the up button 88 is depressed for lifting the seat 12. A down button 90 is movably integrated into a respective one of the closed loops 56 such that the down button 90 is accessible to the user. The down button 90 is electrically coupled to the pair of hydraulic pumps 84 and each of the hydraulic pumps 84 is actuated into the lifting condition when the down button 90 is depressed for lowering the seat 12. A power supply 92 is integrated into the seat 12, the power supply 92 is electrically coupled to each of the hydraulic pumps 84 and the power supply 92 comprises at least one battery. A battery cover 94 is removably attached to the bottom surface 20 of the seat 12 and the battery cover 94 forms a fluid impermeable seal with the seat 12. In this way the battery cover 94 inhibits the power supply 92 from getting wet when the seat 12 is submerged.

In use, the seat 12 is positioned in the bathtub 16 and the user sits on the seat 12. The user depresses either the up button 88 or the down button 90 to adjust the seat 12 to a desired height. In this way the user can submerge their lower body in the bathtub 16 without having to bend over or support their own weight. The slot 14 facilitates the user to bathe their genitals and inner thighs while the user is sitting on the seat 12. The seat 12 can be lifted to a maximum height in order to assist the user with standing up and exiting the bathtub 16.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An adjustable bathing chair assembly for supporting a user at an adjustable height in a bathtub for bathing, said assembly comprising:

a seat having a slot being integrated into said seat wherein said seat is configured to have a user sit thereon such that the user's genitals and inner thighs are accessible through said seat, said seat being comprised of a fluid impermeable material wherein said seat is configured to be positioned in a bathtub to facilitate the user to bathe themselves;

a back rest being disposed on said seat wherein said back rest is configured to support the user's back;

a pair of closed loops, each of said closed loops being coupled to and extending upwardly from said seat such that each of said closed loops defines an arm rest;

a plurality of hydraulic pistons, each of said hydraulic pistons being coupled to and extending downwardly from said seat such that each of said hydraulic pistons defines a respective leg of said seat wherein each of said hydraulic pistons is configured to support said seat above a floor of the bathtub, each of said hydraulic pistons comprising a plurality of telescopic sections slidably engaging each other such that each of said hydraulic pistons has an adjustable length;

a plurality of feet, each of said feet being coupled to a respective one of said hydraulic pistons wherein each of said feet is configured to rest on the floor of the bathtub; and a pair of hydraulic pumps, each of said hydraulic pumps being integrated into said seat, each of said hydraulic pumps being in fluid communication with a respective pair of said hydraulic pistons, each of said hydraulic pumps being actuatable in a lowering condition to extend said hydraulic pistons wherein said seat is configured to be raised from the floor of the bathtub, each of said hydraulic pumps being actuatable in a lifting condition to retract said hydraulic pistons wherein said seat is configured to be lowered to the floor of the bathtub.

2. The assembly according to claim 1, wherein:

said seat has a top surface, a bottom surface and a perimeter surface extending between said top surface and said bottom surface, said perimeter surface having a front side, a back side, a first lateral side and a second lateral side, said slot extending through said top surface and said bottom surface, said slot extending from said front side toward said back side, said slot having a bounding edge, said bounding edge having a pair of parallel sections and a rounded section, each of said parallel sections extending from said front side toward said back side, said rounded section extending between said parallel sections having said rounded section being centrally positioned on said seat;

said assembly includes a back rest support having a first end and a second end, said back rest support having a bend thereon, said first end being coupled to said back side of said perimeter surface of said seat having said second end being directed upwardly from said seat; and said back rest has a front side, a back side and a bottom edge, said bottom edge being coupled to said second end of said back rest support, said back rest having a hole extending through said front side and said back side wherein said hole is configured to facilitate said back rest to be gripped.

3. The assembly according to claim 2, wherein each of said closed loops has an outer surface, said outer surface of each of said closed loops being coupled to said top surface of said seat, each of said closed loops being positioned adjacent to a respective one of said first lateral side and said second lateral side of said perimeter surface of said seat, each of said closed loops being elongated to extend substantially between said front side and said back side of said perimeter surface.

4. The assembly according to claim 1, wherein said plurality of telescopic sections of each of said hydraulic pistons includes a top section, a middle section and a bottom section, each of said top section and said middle section being hollow, said top section and said middle section being in fluid communication with each other, said bottom section having a distal end with respect to said middle section, said top section having a top end, said top end of said top section of each of said hydraulic pistons being recessed into a bottom surface of said seat such that each of said hydraulic pistons is aligned with a respective one of four corners of said seat, said top section of each of said hydraulic pistons having an input port extending into an interior of said top section.

5. The assembly according to claim 4, further comprising a plurality of conduits, each of said conduits being fluidly coupled between a respective one of said hydraulic pumps and said input port on said top section of a respective one of said hydraulic pistons for directing hydraulic fluid into and out of said respective hydraulic piston.

6. The assembly according to claim 1, further comprising:

an up button being movably integrated into a respective one of said closed loops wherein said up button is configured to be accessible to the user, said up button being electrically coupled to said pair of hydraulic pumps, each of said hydraulic pumps being actuated into said lowering condition when said up button is depressed for lifting said seat;

a down button being movably integrated into a respective one of said closed loops wherein said down button is configured to be accessible to the user, said down button being electrically coupled to said pair of hydraulic pumps, each of said hydraulic pumps being actuated into said lifting condition when said down button is depressed for lowering said seat; and a power supply being integrated into said seat, said power supply being electrically coupled to each of said hydraulic pumps, said power supply comprising at least one battery.

7. An adjustable bathing chair assembly for supporting a user at an adjustable height in a bathtub for bathing, said assembly comprising:

a seat having a slot being integrated into said seat wherein said seat is configured to have a user sit thereon such that the user's genitals and inner thighs are accessible through said seat, said seat being comprised of a fluid impermeable material wherein said seat is configured to be positioned in a bathtub to facilitate the user to bathe themselves, said seat having a top surface, a bottom surface and a perimeter surface extending between said top surface and said bottom surface, said perimeter surface having a front side, a back side, a first lateral side and a second lateral side, said slot extending through said top surface and said bottom surface, said slot extending from said front side toward said back side, said slot having a bounding edge, said bounding edge having a pair of parallel sections and a rounded section, each of said parallel sections extending from said front side toward said back side, said rounded section extending between said parallel sections having said rounded section being centrally positioned on said seat;

a back rest support having a first end and a second end, said back rest support having a bend thereon, said first end being coupled to said back side of said perimeter surface of said seat having said second end being directed upwardly from said seat;

a back rest being disposed on said seat wherein said back rest is configured to support the user's back, said back rest having a front side, a back side and a bottom edge, said bottom edge being coupled to said second end of said back rest support, said back rest having a hole extending through said front side and said back side wherein said hole is configured to facilitate said back rest to be gripped;

a pair of closed loops, each of said closed loops being coupled to and extending upwardly from said seat such that each of said closed loops defines an arm rest, each of said closed loops having an outer surface, said outer surface of each of said closed loops being coupled to said top surface of said seat, each of said closed loops being positioned adjacent to a respective one of said first lateral side and said second lateral side of said perimeter surface of said seat, each of said closed loops being elongated to extend substantially between said front side and said back side of said perimeter surface;

a plurality of hydraulic pistons, each of said hydraulic pistons being coupled to and extending downwardly from said seat such that each of said hydraulic pistons defines a respective leg of said seat wherein each of said hydraulic pistons is configured to support said seat above a floor of the bathtub, each of said hydraulic pistons comprising a plurality of telescopic sections slidably engaging each other such that each of said hydraulic pistons has an adjustable length, said plurality of telescopic sections of each of said hydraulic pistons including a top section, a middle section and a bottom section, each of said top section and said middle section being hollow, said top section and said middle section being in fluid communication with each other, said bottom section having a distal end with respect to said middle section, said top section having a top end, said top end of said top section of each of said hydraulic pistons being recessed into said bottom surface of said seat such that each of said hydraulic pistons is aligned with a respective one of four corners of said seat, said top section of each of said hydraulic pistons having an input port extending into an interior of said top section;

a plurality of feet, each of said feet being coupled to a respective one of said hydraulic pistons wherein each of said feet is configured to rest on the floor of the bathtub, each of said feet including a cup and a collar extending upwardly from said cup, said collar insertably receiving said distal end of said bottom section of said respective hydraulic piston, said cup being comprised of a deformable material wherein said cup is configured to be compressed against the floor of the bathtub for suctionally engaging the floor;

a pair of hydraulic pumps, each of said hydraulic pumps being integrated into said seat, each of said hydraulic pumps being in fluid communication with a respective pair of said hydraulic pistons, each of said hydraulic pumps being actuatable in a lowering condition to extend said hydraulic pistons wherein said seat is configured to be raised from the floor of the bathtub, each of said hydraulic pumps being actuatable in a lifting condition to retract said hydraulic pistons wherein said seat is configured to be lowered to the floor of the bathtub;

a plurality of conduits, each of said conduits being fluidly coupled between a respective one of said hydraulic pumps and said input port on said top section of a respective one of said hydraulic pistons for directing hydraulic fluid into and out of said respective hydraulic piston;

an up button being movably integrated into a respective one of said closed loops wherein said up button is configured to be accessible to the user, said up button being electrically coupled to said pair of hydraulic pumps, each of said hydraulic pumps being actuated into said lowering condition when said up button is depressed for lifting said seat;

a down button being movably integrated into a respective one of said closed loops wherein said down button is configured to be accessible to the user, said down button being electrically coupled to said pair of hydraulic pumps, each of said hydraulic pumps being actuated into said lifting condition when said down button is depressed for lowering said seat; and a power supply being integrated into said seat, said power supply being electrically coupled to each of said hydraulic pumps, said power supply comprising at least one battery.

* * * * *